United States Patent [19]

Fleek et al.

[11] 4,448,123

[45] May 15, 1984

[54] VARIABLE SPEED PRINTING FOR DOT MATRIX PRINTERS

[75] Inventors: Arthur E. Fleek, Cary, N.C.; Samuel C. Tseng, Pleasantville, N.Y.

[73] Assignee: International Business Machines, Armonk, N.Y.

[21] Appl. No.: 394,054

[22] Filed: Jun. 30, 1982

[51] Int. Cl.[3] ..... B41J 3/12; B41J 1/20

[52] U.S. Cl. ..... 101/93.04; 101/93.14; 400/121; 400/146

[58] Field of Search ..... 400/121, 146; 101/93.04, 93.09, 93.14

[56] References Cited

U.S. PATENT DOCUMENTS

| | | | |
|---|---|---|---|
| 3,161,126 | 12/1964 | Saltz | 101/93 |
| 3,289,576 | 12/1966 | Bloom, Jr. et al. | 101/93 |
| 3,303,775 | 2/1967 | Giannuzzi | 101/93 |
| 3,827,357 | 8/1964 | Mahoney | 101/93.14 |
| 4,399,748 | 8/1983 | Thorne | 101/93.04 |

FOREIGN PATENT DOCUMENTS

| | | | |
|---|---|---|---|
| 36970 | 10/1981 | European Pat. Off. | 400/146 |

*Primary Examiner*—Paul T. Sewell
*Attorney, Agent, or Firm*—Otto Schmid, Jr.

[57] ABSTRACT

A variable speed printing (VSP) adaptor for a dot matrix printer which includes a monitoring means having a plurality of devices each capable of assuming one of two states. The monitoring means monitors the state of the pattern data to be printed, and, in the preferred embodiment, the monitoring means comprises a counter which is preset with a number equal to the number of column scans with a dot print line. The pattern data to be printed is scanned in a forward direction, i.e., in the normal printing direction starting at the first print position and the count in the counter is decremented one count for each column data scanned. During the time interval between when this data is latched and the actual hammer actuation, the pattern data is scanned in the backward direction starting at the last print position. Each time the column data for a backward scan is zero, i.e., no dot to be printed, prior to sensing a non-zero column, the count in the counter is decremented one count. The printing operation continues in the interleaved forward/backward scans until the count in the counter reaches a reference level such as zero. Upon sensing this reference level in the counter, a control signal is generated which indicates that the printing of the dot row is complete and initiates movement of the paper to the next dot row position. In an alternate embodiment, the monitoring means comprises a random access storage device.

7 Claims, 7 Drawing Figures

VARIABLE SPEED PRINTING FOR DOT MATRIX PRINTERS

BACKGROUND OF THE INVENTION

1. Field of Invention

This invention relates to impact matrix printing and, more particularly, to a printer apparatus operable at higher rates of speed.

2. Description of the Prior Art

A variety of dot matrix printers are known in the prior art. The development of these printers has progressed to a level at which high printing speeds can be achieved. However, in general, these printers go through a set mode of operation to print a line of characters so that their printing rate is constant regardless of the data to be printed.

SUMMARY OF THE INVENTION

It is, therefore, the principal object of this invention to provide a dot matrix printer which enables an increase in printing speed without changing its mechanical configuration.

It is another object of this invention to provide a printer which produces variable speed dot matrix printing based on the data to be printed and the starting point of the print line relative to the position of the print elements.

Briefly, according to the invention, there is provided a dot matrix printer in which means are provided for monitoring the state of the pattern data to be printed. The monitoring means includes a plurality of devices capable of being set into either of two states, and the devices are set to one state at the beginning of a printing operation. The groups of pattern data to be printed are accessed in the direction the data is to be printed starting at the first print position, and the state of one device in the monitoring means is changed to the state opposite the one state as each of the groups of data are accessed. The data is accessed in a direction opposite to the direction the data is to be printed starting at the last print position, and the state of one of the devices in the monitoring means is changed for each group of pattern data sensed of a second state prior to sensing one group of data having a first state. Means are provided for sensing when the number of devices of the monitoring means set to the state opposite the one state reaches a reference level to indicate to the printer that all the data for that dot line has been printed.

In a first specific embodiment, the monitoring means comprises a counter into which a predetermined count is set at the beginning of a printing operation. Each time a group of data is accessed in the direction printing is to occur, the count in the counter is decremented by one count. In addition, each time a group of data accessed in the direction opposite the direction printing is to occur which is sensed to have a second state prior to sensing a group of data having a first state, the count in the counter is decremented one count. The count in the counter is sensed after each change and, when the count reaches a reference level such as zero, a signal is generated which indicates to the printer that the dot print line is complete.

In a second specific embodiment, the monitoring means comprises a Random Access Memory (RAM) which has a number of storage locations initially set to a first state. The storage locations are set to the state opposite the first state as the data groups are accessed, as previously described. The state of the memory locations is sensed and, when the number of storage locations in the state opposite the first state reaches a reference level, a signal is generated which signifys to the printer that the dot print line is complete.

DESCRIPTION OF THE PREFERRED EMBODIMENT

The present invention relates to variable speed printing which enables a specific printer to increase the printing speed without changing its given mechanical configuration. The invention will be described as applied to a specific embodiment of a dot matrix printer, but it will be recognized by those skilled in the art that the invention is not so limited.

Figure 1:
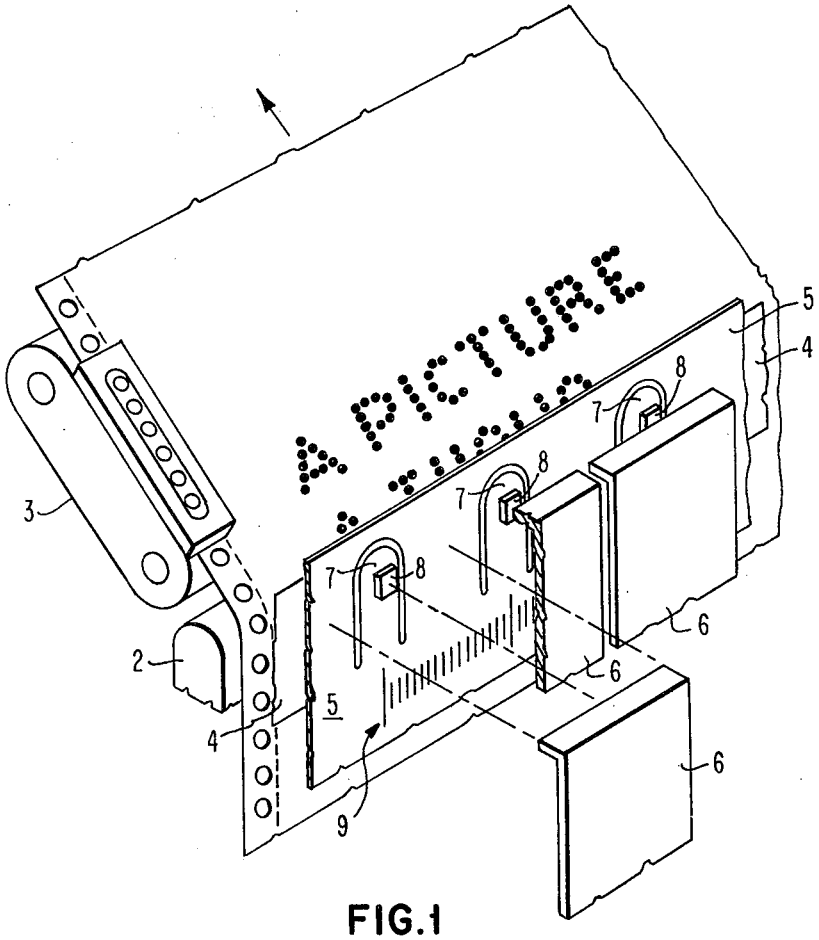
FIG. 1 shows the primary functional elements of a preferred embodiment of a printer to which the invention is applicable.

A preferred embodiment of the dot matrix printer apparatus is shown in FIG. 1. The paper or media 1 to be marked by the printer is shown together with a suitable platen 2 and a paper motion tractor or driver means 3 for moving paper 1 in the general direction of the arrow shown. An appropriate ribbon 4 is interposed in front of the paper 1 and may be supported and driven by conventional means not shown in FIG. 1.

A movable band or belt 5 is interposed in front of the ribbon 4 in a position separated from both the paper 1 and ribbon 4 and adjacent to, but separate from, a bank of one or more impact hammers 6. The belt or band 5 may contain one or more print element dot forming means. These are generally shown as a movable or flexible finger 7 integrally formed with belt 5 and carry an anvil or impact face 8 on its back side and a print element 10 (see FIG. 2) on the side facing paper 1. The side of finger 7 (and of print element 10 and anvil 8) facing paper 1 is not shown in FIG. 1. However, it will be understood to contain (see FIG. 2) a raised projection or print element 10 in the appropriate plan or form to provide a dot of the desired shape on paper 1 when anvil 8 is struck by one of the hammers 6 to deflect the finger 7 and impact the print element against the ribbon 4 and paper 1. A plurality of timing marks or slots 9 are provided on band 5. As is known in the art, either optically transparent slots or magnetically or mechanically sensible marks may be made on belt or band 5 to appropriately time the motion of the belt 5 past the hammer array 6.

For maximum throughput, it is desirable that there be as many print hammers 6 as there are print element fingers 7 across the length of the print line on paper 1. For a printing operation at appropriate positions across the length of the print line, the individual hammer actuators 6 are caused to operate to impact the anvil surfaces 8. When all of the desired print positions along the print line have been provided and each of the print hammers has been fired at the appropriate number of times and places to create the dots, paper 1 will be stepped in the direction perpendicular to band 5 to the next desired row position and the printing operation will be repeated. Depending on the font of the characters, seven rows of linear dot patterns or more constitute a character line.

Should additional information relative to the apparatus or operation of the printer be desired, these additional details can be obtained from copending application Ser. No. 334,950 filed Dec. 28, 1981 by W. D. Thorne entitled "Band and Hammer Dot Matrix Printer."

In the conventional operation of the printer shown in FIG. 1, the time to print one row of linear dot patterns is the time in which the band 5 travels across the distance of a font pitch Pf, or an integer multiple of the font pitch. The present invention permits printing in a variable time, and this mode of operation will be described below. First, however, a description of the conventional mode of operation will be presented so that our improved operation can be better understood.

Figure 2:
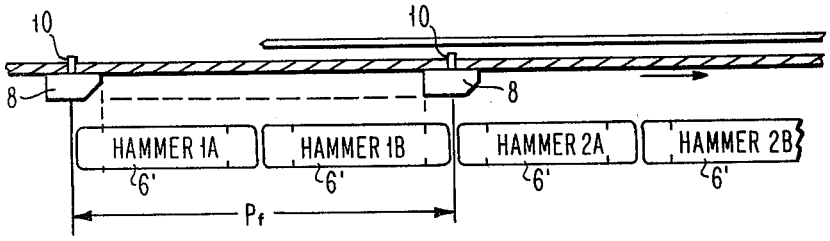
FIG. 2 shows the arrangement of dot band elements relative to the hammer faces in the printer to which the invention is applicable.

For convenience in explanation, assume that the font pitch Pf has a distance covering 120 dot positions. For ten dot positions per character, the font pitch equals 12 characters wide. Should hammers of the same 12 character width be used, there is a possibility that one hammer can strike two print elements at the same time, or two hammers strike one print element at the same time. To avoid this possibility, as described in copending application Ser. No. 333,092, rather than using one 12 wide hammer, a pair of two 6 wide hammers are used, as shown in FIG. 2. This means that the print elements 10 can be in front of only the odd numbered hammers 1A, 2A, or only the even numbered hammers 1B, 2B. Consequently, when the odd numbered hammers 1A, 2A are active, the even numbered hammers 1B, 2B are idle or vice versa. In the specific embodiment shown in FIG. 2, the total number of hammers 6' will be 22, each spanning six character positions, in order to print the maximum limit or 132 characters in a line. However, electronically it can be considered as if there were only 11 hammers, each of which is 12 characters wide, although the current supplied to each hammer is for the smaller 6 wide hammer.

Assuming the initial position of the first print element 10 is at the position, say, 93rd of the 1320 total dot positions on the paper (see FIG. 3), then the belt timing mark 9 of the first print element 10 is pointing at the 9th print position (the 9th character) of the 132-character print line. At this time, the 11 print elements 10 are respectively pointing at the 11 positions whose locations in the print line are $$\text{Character position} = 9 + (n - 1)\cdot 2, \text{ where } n = 1, 11 (\text{where } n \text{ is from 1 to 11})$$

Since the first print element 10 is at the 93rd position of the total of 1320 dot positions, the pointer is incremented by 3 from 90. (90 is the first column position of the 9th character, because each character is 10 dots wide). Thus, an address is generated to access the actual column or vertical slice of the image data 25 to be printed. This address reads the vertical column of the image data to a register 27, and a row counter and selector 28 select the appropriate row of that column. The first hammer is idle, if the bit selected from this row is "zero" and is activated to strike if the bit selected is "one". In the example shown in FIG. 3, for row 0 the first hammer is set for actuation by setting a 1 bit in hammer shift register 32.

The above description tells how the control circuits select a bit from the image data to control the first hammer. One must bear in mind that there are 11 print elements 10. The control circuits select one image bit from the same row of the respective 11 columns (pointed at by the 11 print elements) to form an 11 bit word. When this 11 bit word is supplied to control the 11 active hammers, the following 11 out of the 1320 dot positions are printed, $$P(93,t,n) = 93 + (n - 1)\cdot 120, \text{ where } n = 1, 11, \text{ for } t = 1$$

This means that at the instant t=1, the first print element 10 is at position 93. And the belt will print either black or white at positions 93, 213, 333, 453, 573, 693, 813, 933, 1053, 1173 and 1293, depending upon the image data accessed and set in hammer shift register 32. As the belt 5 traverses from right to left to the next dot position ($t=t+1$), the control circuits select another 11 bit word to print at the next 11 dot positions by accessing the image data for columns 92, 212, 332, 452, etc.

The control circuits select 120 words (t=1, 120) of 11 bits each, in order to print 1320 dot-positions. These 120 words are selected from the 1320 slices in the following sequences.

$$P(93,t,n) = 93 + (t - 1)) + (n - 1)\cdot 120, \text{ where } n = 1,11 \text{ for each } t = 1,(120 - 93 + 1)$$

$$= (93 + (t - 1) - 120) + (n - 1)\cdot 120, \text{ where } n = 1,11 \text{ for each } t = (120 - 93 + 2),120.$$

We can now generalize the above equation by replacing 93 by I, $$P(I,t,n) = (I + (t - 1)) + (n - 1)\cdot 120, \text{ where } n = 1,11, \text{ for each } t = 1,(120 - I + 1) \quad (A)$$

$$= (I + (t - 1) - 120) + (n - 1)\cdot 120, \text{ where } n = 1,11 \text{ for each } t = (120 - I + 2),120$$

where I is the initial position of the first print element to start printing this row of dot patterns. Thus, I can be any one of the 120 dot positions.

The characteristic of the printer when operating under the conventional control is constant speed printing. Even if there is only one dot to print in the whole row, the control circuits still go through the control algorithm for all the 120 words. The printing speed for one row of dot patterns is constant regardless of the initial position I of the print elements.

In contrast to the conventional operation just described, our invention provides for variable speed printing (VSP) by sensing the print data to find the last non-zero PRINT SCAN in equation (A) and terminating the printing of the dot row pattern prematurely, if possible, based on the sensed data by the use of a VSP adaptor. As an example, assume that the dot pattern for a row to be printed contains only a few scattered dots and that the last non-zero word occurs at t=T, then all the 11 bit words after t=T in Eq. (A) are zero. A zero word means that all the 11 hammers need not to strike when this word is latched to the output. Clearly, the adaptor should process the printing from t=1 to T, but it should save the time to be spent for $t=(T+1)$ to 120. The variable speed printing will do exactly this to save (120-T) 500 microseconds for each font pitch.

The VSP has the following characteristics which are not found in the conventional mode of operation.

In printing a dot pattern, the VSP adaptor finishes the dot pattern at the last non-zero 11 bit word, say t=T, for T=<120. Since T is dependent on the initial position of the print element I (see Eq. (A)), the time saved depends on where the print elements are when the printer starts to print this dot pattern. The printer, thus, yields different printing times even for printing the same dot pattern. Consequently, one can not say how much time the printer will take to print a given dot pattern. One can only say that for a given dot pattern, the printer yields different values of printing time at 120 possible initial belt dot positions. And the average of those 120 values is the average printing operation, the printing time for this dot pattern can take less or more time than the average. But it will be always less or, in the worst case, equal to that of the constant speed mode of operation. The worst case occurs when the initial print element positions happen to be such that the non-zero 11 bit word occurs at t=120 in equation (A), i.e., the selected bits at P(I,120,n) have at least one non-zero for n=1,11 (where n is from 1 to 11).

For simplicity, let us call one 11 bit word in equation (A) as one COLUMN SCAN. The variable speed adaptor is designed essentially to find the last non-zero column scan in Eq. (A).

The VSP principle can be implemented in a manner which takes advantage of the difference in operating speed between electronic operations and electromechanical operations. For example, the VSP adaptor takes about 11 microseconds to select the first column scan from the columns at P(I,1,n), n−1, 11, and stores it in an output register. However, due to the recycle time of the print hammers, this data cannot be utilized by the print hammers until a time span of 500 microseconds has elapsed. At the end of the 500 microseconds, this column scan data is latched to the 11 hammers.

During this 500 microseconds, while the content of the output register is waiting to be used, the adaptor can generate 44 more column scans. The VSP adaptor is designed, in fact, to test 44 column scans backward from t=120 to $t=120-44+1=77$ in Eq. (A). If no non-zero column scan is found in this group, then the second forward column scan selected from P(I,2,n),n=1, 11 is sent to the output register, and another 44 column scans are tested from t=76 to t=33 in Eq. (A). If a non-zero scan cannot still be found in this group, then the 3rd forward column scan selected from P(I,3,n), n=1, 11 is processed, and during the subsequent 500 microseconds, all the rest of the column scans from t=32 to t=4 in Eq. (A) can be tested.

By virtue of this testing process, in which some column scans are made in the forward direction (i.e., in the direction the column data is to be printed within the dot pattern row) and additional column scans are made in the reverse direction, an indication is provided that this dot pattern can be finished when the belt traverses T dot positions. In response to this indication, the time normally required to print the column scan data from $t=T+1$ to 120 in Eq. (A) can be saved.

Figure 3:
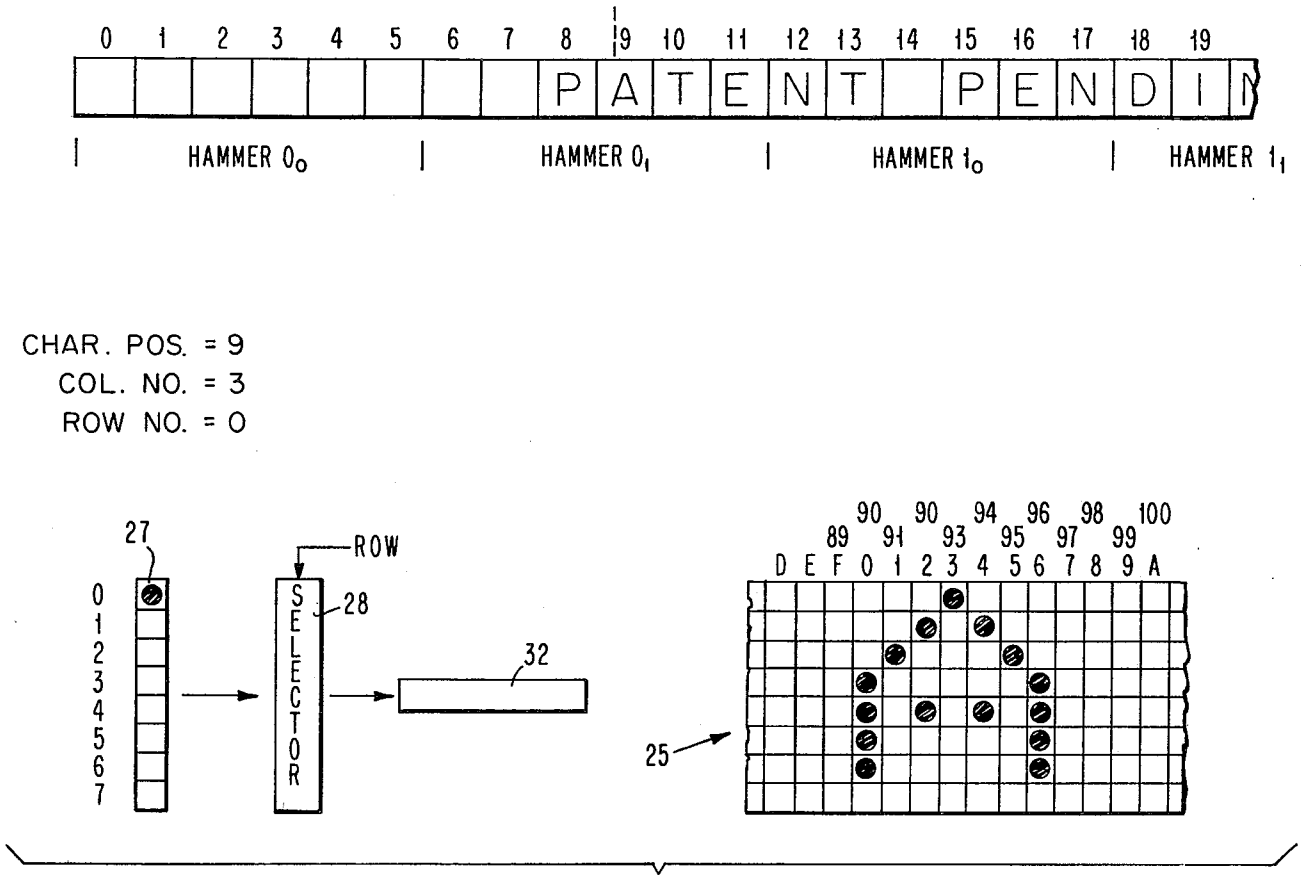
FIG. 3 is a diagram illustrating the manner in which pattern data to be printed is processed and presented to the control circuits of the printer shown in FIGS. 1 and 2.

A specific example will now be given for VSP operation for the specific configuration shown in FIG. 3. A monitoring means is set to a number equal to the number of hammer actuations required to print an entire dot line, or 120 in the specific example. At the first COLUMN SCAN, the data is sensed as described above for the conventional operation for the data to be printed in columns 93, 213, 333, 453, 573, 693, 813, 933, 1053, 1173 and 1293, and this 11-bit data word is latched to activate the appropriate hammers, and the number in the monitoring means is changed by one. At this time, the forward scan control circuits must wait for the hammers to execute this data and this takes about a 500 microsecond waiting time.

During this waiting time, the first series of backward COLUMN SCANS are executed starting at the last print position for each print element or at addresses 94, 214, 334, 454, 574, 694, 814, 934, 1052, 1172, and 1294. At each of the backward COLUMN SCANS in which the 11 bit word is all "zero", the number in the monitoring means is changed by one. Since the backward scans take place at electronic speed (11 microseconds in the specific example), a large number (44 in the specific example) can be executed within the manner execution waiting time. Thus, the VSP circuits scan the data from column positions 94, etc. (11 columns) back to 18, 138, etc. (11 columns) during the waiting time between selecting the hammers to be actuated and the actual printing of this data.

During the second forward scan, the column data at columns 92, 212, 332, 452, etc. (11 columns) is accessed and sent to actuate the hammers. During the subsequent execution waiting time, the second series of backward scans of the print image data can be made for columns 19, 139, etc. (11 columns) back to 182, etc. (11 columns).

The third forward scan accesses the data for columns 91, 211, 331, etc. (11 columns) and sends this to the hammers. During the subsequent waiting time, the third series of backward scans can be made for columns 63, 183, etc. (11 columns) back to 94, 214, etc. (11 columns).

Note that after the third forward scan, the entire line of image data has been accessed and the number then in the monitoring means specifies the number of columns of data still to be printed. In subsequent forward scans for columns 90, etc. the number in the monitoring means is changed one for each column accessed and printed. When the number in the monitoring means reaches a reference level, the end of the dot print line is signalled and a paper advance signal is also generated.

The control circuits for operating the printer are not shown in detail. It is well known in the band and hammer style of printer to provide optical or other sources of indicia on the moving band such as timing marks 9 which can generate emitter output pulses for timing hammer impacts. It is only necessary to count some number of these pulses starting from an initial home position in order to determine whether the hammers are appropriately positioned for firing. Circuitry of this type is known and employed in printers of this style. Therefore, the details of this circuitry and the timing are not shown since they do not form a specific part of the present invention and are quite obvious to those of ordinary skill in this art.

Figure 4:
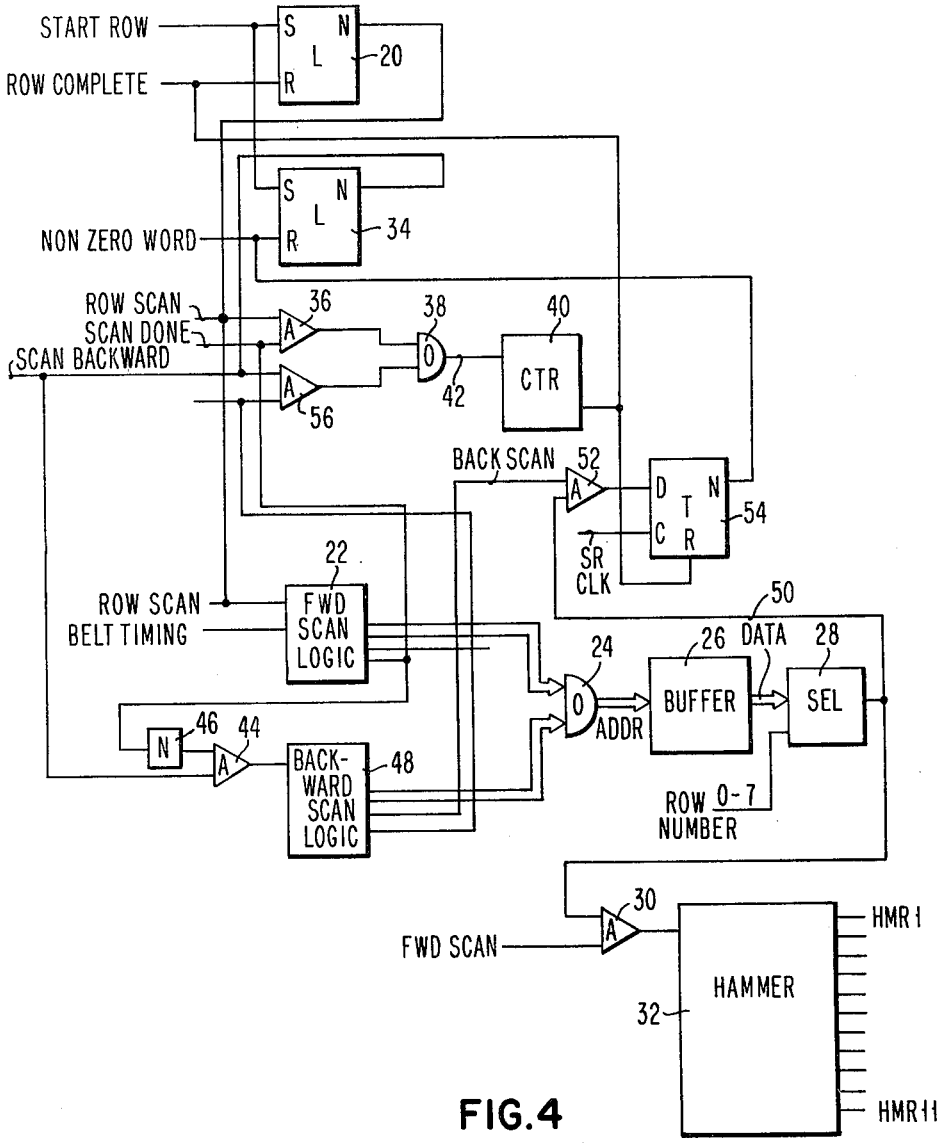
FIG. 4 is a block diagram of a specific embodiment of circuitry for controlling the variable speed printing operation according to the present invention for a printer such as that shown in FIGS. 1 and 2.

In the specific embodiment of the invention shown in FIG. 4, a row scan latch 20 is set by the signal START ROW which is generated by the normal control circuits of the printer (not shown). The output of latch 20 is the signal ROW SCAN. The signals ROW SCAN and BELT TIMING (from timing marks 9 on belt 5) are coupled as inputs to Forward Scan Logic 22. Forward Scan Logic 22 generates addressing signals for the specific column scans (i.e., one for each of 11 hammers) to be performed in accordance with Eq. (A). The address signals are coupled sequentially through OR circuit 24 to access the column scan data from Print Line Image Buffer 26. Buffer 26 is a random access memory (RAM) which stores the image data for one print line. The specific example utilizes 132 characters per line, each 10 column wide, and the characters each comprise 8 rows as shown in FIG. 3. Therefore, buffer 26 comprises a RAM having at least 1320 8-bit bytes of storage.

Figure 6:
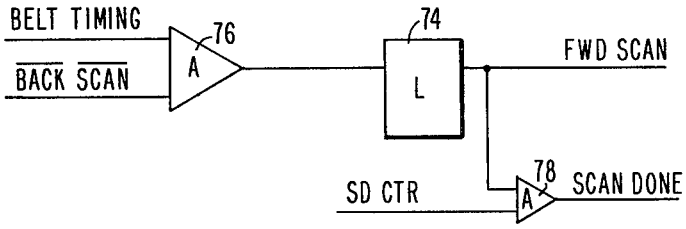
FIG. 6 is a block diagram of a part of the control signals generated by the forward scan logic.

Each address from Forward Scan Logic 22 causes the designated byte to be read out from Buffer 26 to Select Register 28. A gating signal ROW NUM 0–7 is coupled to register 28. The ROW NUM 0–7 signal is generated by the row counter (not shown) to designate the specific one of the 8 rows of the characters within the print line which is currently being printed. The corresponding bit 0–7 of register 28 is gated through AND circuit 30 to set the appropriate bit within Hammer Shift Register 32 when the signal FWD SCAN is up to condition AND circuit 30. The signal FWD SCAN is generated by the Forward Scan Logic 22 as the output of latch 74 (FIG. 6). Latch 74 is set in response to conditioning AND circuit 76 by the signals BELT TIMING and $\overline{\text{BACK SCAN}}$.

This operation continues through all eleven of the addresses selected by Logic 22 and, at this time, the 11 hammer fire signals are stored in shift register 32. These signals are latched for control of the hammers 6 at the appropriate timing to produce a dot at the appropriate place within the print row. The signal SCAN DONE is generated by Forward Scan Logic 22 after all 11 column data has been accessed. The signal SCAN DONE is generated by the presence to condition AND circuit 78 (FIG. 6) of the signals SD CTR and FWD SCAN. The signal SD CTR is generated in response to a counter (not shown) reaching a count equal to the number of column data to be accessed (11 in the specific example). AND circuit 36 is conditioned when the SCAN DONE signal comes up to produce a signal through OR circuit 38 to the DECREMENT input of counter 40. Counter 40 is a count down counter which is preset in response to the START ROW signal to a value equal to the number of column scans required to print a row which is 120 in the specific example being considered. As each of the column scans is completed, AND circuit 36 is conditioned to decrement counter 40 by one count by a signal coupled on line 42 to the DECREMENT input of the counter 40.

The signal SCAN BACKWARD is generated as the output of Scan Backward Latch 34 in response to the signal START ROW and the output signal SCAN BACKWARD is coupled as one input to AND circuit 44. The other input comprises the signal SCAN DONE coupled through INVERTER 46 so that AND 44 is conditioned when the signal SCAN DONE goes down. The conditioning of AND circuit 44 generates a signal which energizes Backward Scan Logic 48.

Figure 7:
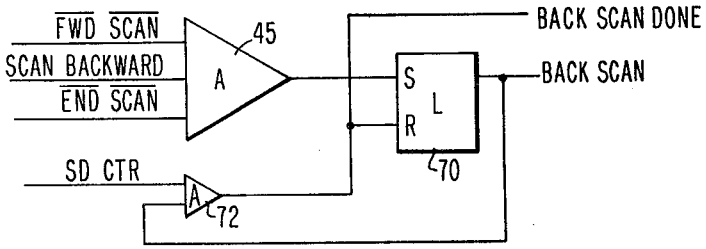
FIG. 7 is a block diagram of a part of the control signals generated by the backward scan logic.

Backward Scan Logic 48 generates the addresses for sequential column scans, starting at the last print position for each of the hammers, i.e., print position 120 in the specific example. The address signals are coupled through OR circuit 24 to Buffer 26 to read out the character data for the selected column to selector register 28. The data is coupled over line 50 to provide one input to AND circuit 52. The other input to AND circuit 52 is provided by the signal BACK SCAN which is generated by Backward Scan Logic 48. The signal BACK SCAN is generated by coupling the output of AND circuit 45 to set latch 70 (FIG. 7). The BACK SCAN signal is up until the number of memory cycles have been generated to access all 11 columns of data at which time the signal SD CTR goes up to condition AND circuit 72 and reset latch 70 so that signal BACK SCAN DONE is generated. Should there be a 1 bit within the data, AND circuit 52 would be conditioned thereby to produce an output which is coupled to set Trigger 54. Trigger 54 generates an output signal NON ZERO WORD which is coupled to the reset input of Latch 34 so that the signal SCAN BACKWARD would come to a down level.

Should there be no 1 bit within the data for a particular column, the signal BACK SCAN DONE from Backward Scan Logic 48 comes up to condition AND circuit 56 and OR circuit 38 to provide a signal to the DECREMENT input of counter 40. This operation continues from the last print position sequentially in a backward scan toward the first print position, i.e., 120, 119, 118 . . . until one of two conditions occurs. Should a non-zero word be detected, Trigger 54 is set which causes Latch 34 to be reset so that the signal SCAN BACKWARD goes down. This deconditions AND circuit 44 so that no further backward scans occur.

In this case, the printer continues in the conventional forward scan mode a number of column scans equal to the count remaining in counter 40 since decrementing the count in counter 40 to zero generates the signal ROW COMPLETE. In response to this signal, latch 20 and trigger 54 are reset and the appropriate vertical positioning signal is coupled to feed means 3 to produce the desired row spacing.

The second alternative is that the backward scans continue until the number of backward scans that can be executed within the available time is reached. At this time, the END SCAN signal comes up to decondition AND circuit 45 so that the signal BACK SCAN goes down and a further forward scan can be executed as previously described. During this time, the BACK SCAN signal is down so that trigger 54 is not affected by the forward scan data.

The operation continues in this manner in a combined forward/backward scan of the print data with counter 40 being decremented one count for each forward scan completed. In addition, the counter 40 is decremented one count for each zero word sensed in the backward scan prior to the time a non-zero word is sensed. When the count in counter 40 reaches zero, the signal ROW COMPLETE is generated as described above. This mode of operation has the advantage that the time required to execute a number of forward column scans is saved and the number is equal to the number of zero words sensed in the backward scan prior to sensing a non-zero word in the backward scan.

Figure 5:
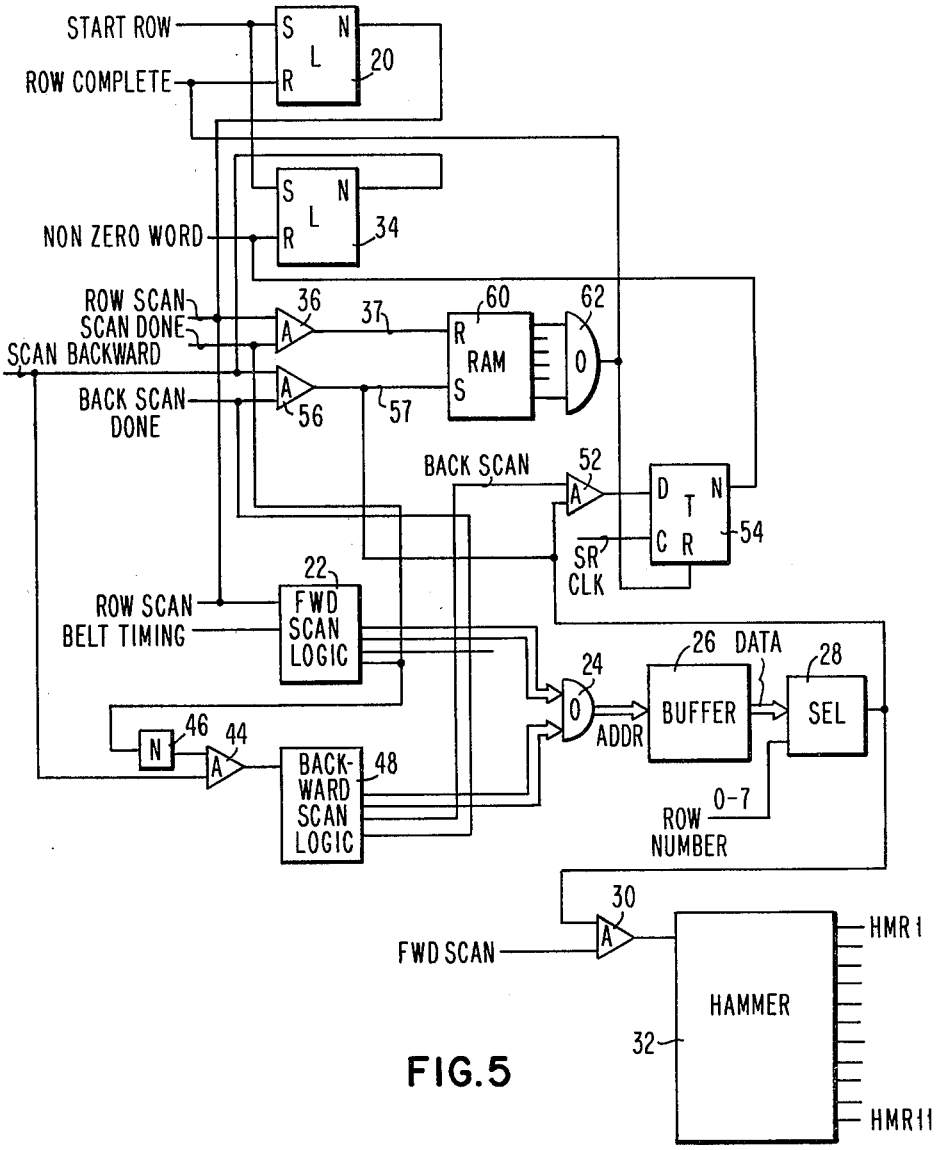
FIG. 5 is a block diagram of an alternate embodiment of circuitry for controlling the variable speed printing operation according to the present invention for a printer such as that shown in FIGS. 1 and 2.

An alternate embodiment for the VSP adaptor is shown in FIG. 5 in which a 120 bit random access memory (RAM) is provided in the adaptor to record the states of the 120 column scans. The state of a column scan is one if any one of the 11 bits in the column scan is non-zero. The state of a column scan is zero if all 11 bits of the column scan are zero.

Every time a row of dot pattern is to be printed, the 120 bit RAM 60 is reset to zero for initialization. Then, for an arbitrary initial print element position I, the adaptor selects the first column scan from the slices at positions P(I,1,n), n=1, 11, and stores this data in the shift register 32. This takes about 11 microseconds. There is a period of 500 microseconds available before this first column scan data is executed by the hammers. During this period, there is enough time for the adaptor to select 44 column scans backward from P(I,120,n), n−1, 11 to P(I,77,n), n=1, 11. The states of these 44 column scans are stored at the 120th bit to the 77th bit in the RAM 60 by an input on line 57 to the SET input of RAM 60.

At the end of the 500 microseconds, the first print scan in the shift register 32 is transferred to the output latch for the hammers, and the adaptor selects the second column scan from P(I,2,n), n=1, 11 and stores it in the shift register 32. Again, during the next 500 microseconds, the next 44 column scans are read backward from P(I,76,n), n=1, 11 to P(I,33,n), n=1, 11. The states of these 44 column scans are stored in the RAM 60 at the 76th bit to the 33rd bit.

Similarly, by the time the 3rd column scan P(I,3,n), n=1, 11, are transferred to the output latch for the hammers, the 3rd group of the states of the column scans from P(I,32,n), n=1, 11 to P(I,4,n), 1=1, 11 are stored in the RAM.

From now on, every time the column scan from P(I,4,n), n=1, 11 on is stored and transferred to the output latch for the hammers, the corresponding state bit in the RAM 60 is reset to zero by an input on line 37 to the RESET input of RAM 60.

Every time a state bit in RAM 60 is reset to zero, the 120 bit RAM 60 is tested by logically ORing all the outputs in OR circuit 62. If all 120 bits are zero, a signal ROW COMPLETE is generated to signal to the adaptor that the dot pattern is finished.

While the invention has been particularly shown and described with reference to a preferred embodiment thereof, it will be understood by those skilled in the art that various changes in the form and details may be made therein without departing from the spirit and scope of the invention.

Having thus described our invention, what we claim as new and desire to secure by Letters Patent is:

1. A dot matrix printing apparatus for printing dots in a pattern along a desired printing line on a recording medium comprising:

a dot font element carrier having a plurality of dot font elements spaced apart from each other by at least a first width measured along said print line;

a plurality of impact hammer means adjacent to said dot font element carrier, and means for actuating said hammer means to produce a mark by one of said dot font elements on said recording medium; and logic circuit means connected to said hammer actuating means for timing said actuation to impact said carrier when said font elements thereon are adjacent to portions of said printing line where printed dots are desired, the improvement comprising:

means for storing a series of groups of pattern data defining where printed dots are desired along said printing line from a first print position to a second print position;

monitoring means for monitoring the state of the pattern data to be printed in said printing line, said monitoring means comprising a plurality of devices capable of being set into either of two states and means for setting a plurality of said devices to one of said states;

first accessing means for accessing said groups of pattern data sequentially in the order said data is to be printed starting at said first print position;

means for setting one of said devices of said monitoring means to the state opposite said one state for each of said groups of data sensed by said first accessing means;

second accessing means for accessing said groups of pattern data sequentially in the order opposite to the order said data is to be printed starting at said second print position;

means for setting one of said devices of said monitoring means to the state opposite said one state for each of said groups of data sensed by said second accessing means having a second state prior to sensing one group of data having said first state; and sensing means for sensing when the number of devices of said monitoring means set to the state opposite said one state reaches a reference level.

2. The printing apparatus of claim 1 wherein said monitoring means comprises a counter.

3. The printing apparatus of claim 2 wherein said counter is preset to a predetermined count, said means for setting is operable to decrement counter one count for each group of pattern data accessed, and wherein said reference level comprises a zero count.

4. The printing apparatus of claim 1 wherein said monitoring means comprises a random access storage device.

5. The printing apparatus of claim 4 wherein said random access storage device has a plurality of storage locations each comprising at least one bit, means for presetting the storage locations to a first state, and wherein said means for setting is operable to set one storage location to the state opposite said first state for each group of pattern data accessed, and wherein said reference level comprises all of said plurality of storage locations set to the state opposite said first state.

6. The printing apparatus of claim 1 additionally comprising means for generating a control signal in response to said sensing means sensing said reference level.

7. The printing apparatus of claim 6 additionally comprising means responsive to said control signal for terminating said dot row printing operation and for initiating the advancement of the recording medium to a new dot row position.

* * * * *